US010113770B2

(12) United States Patent
Toda et al.

(10) Patent No.: US 10,113,770 B2
(45) Date of Patent: Oct. 30, 2018

(54) WARM AIR HEATER

(71) Applicant: RINNAI CORPORATION, Nagoya-shi, Aichi (JP)

(72) Inventors: Takuya Toda, Aichi (JP); Yukihiko Shimonoma, Aichi (JP)

(73) Assignee: RINNAI CORPORATION, Nagoya-Shi (JP)

( * ) Notice: Subject to any disclaimer, the term of this patent is extended or adjusted under 35 U.S.C. 154(b) by 275 days.

(21) Appl. No.: 14/567,509

(22) Filed: Dec. 11, 2014

(65) Prior Publication Data

US 2016/0169558 A1 Jun. 16, 2016

(51) Int. Cl.
*F24H 9/20* (2006.01)
*F24H 3/06* (2006.01)

(52) U.S. Cl.
CPC ..... *F24H 9/2085* (2013.01); *F24H 3/065* (2013.01)

(58) Field of Classification Search
CPC ..... F24H 3/065; F24H 9/2085
USPC ..... 126/116 A, 99 R
See application file for complete search history.

(56) References Cited

U.S. PATENT DOCUMENTS 4,954,693 A * 9/1990 Mitsuhashi ..... F27B 17/0083 126/21 A
5,395,235 A * 3/1995 Lan-Sun Hung ..... F23C 13/02 431/328
6,109,339 A * 8/2000 Talbert ..... F24D 11/0214 126/101
8,535,050 B2 * 9/2013 Kuroda ..... F23N 5/242 126/116 A
2004/0265759 A1 * 12/2004 Harbeck ..... F23C 3/002 431/16
2007/0068511 A1 * 3/2007 Bachinsky ..... F24C 3/122 126/503
2009/0013985 A1 * 1/2009 Little ..... F24B 1/028 126/67
2009/0215375 A1 * 8/2009 Hagensen ..... F23L 17/005 454/42
2010/0139638 A1 * 6/2010 Hargrave ..... F24C 15/008 126/19 R
2011/0290228 A1 * 12/2011 Tsunekawa ..... F24H 9/2085 126/116 A
2014/0049395 A1 * 2/2014 Hui ..... A01C 7/081 340/608
2014/0311478 A1 * 10/2014 Binzer ..... F24C 3/006 126/503

FOREIGN PATENT DOCUMENTS

JP 58-85016 5/1983
JP 3-233216 10/1991
(Continued)

OTHER PUBLICATIONS

Japanese Office Action dated Mar. 29, 2016, 4 pages.
Japanese Office Action dated Sep. 1, 2015, 4 pages.

*Primary Examiner* — Avinash Savani
*Assistant Examiner* — Aaron Heyamoto
(74) *Attorney, Agent, or Firm* — Rankin, Hill & Clark LLP

(57) ABSTRACT

An orifice 26 is provided in an air supply passage 5*a* of a warm air heater 100, and a differential pressure sensor 28 detects differential pressure Δp between front and rear of the orifice 26 in the air supply passage 5*a*. Rotation speed of the combustion fan 24 is corrected on the basis of the differential pressure Δp detected by the differential pressure sensor 28.

2 Claims, 3 Drawing Sheets

(56) References Cited

FOREIGN PATENT DOCUMENTS

| | | | | |
|---|---|---|---|---|
| JP | 04-155116 | | | 5/1992 |
| JP | 04-227409 | | | 8/1992 |
| JP | 2000-310419 | | | 11/2000 |
| JP | 2000310419 | A | * | 11/2000 |
| JP | 2002-317929 | | | 10/2002 |
| JP | 2004-163045 | | | 6/2004 |
| JP | 2005-83678 | | | 3/2005 |
| JP | 2009-281618 | | | 12/2009 |

* cited by examiner

WARM AIR HEATER

BACKGROUND OF THE INVENTION

1. Field of the Invention

The present invention relates to a warm air heater, and more particularly to a forced supply and exhaust type warm air heater.

2. Description of the Related Art

Heretofore, in a forced supply and exhaust (FF) type warm air heater, a combustion fan is disposed in an air supply passage in order to supply combustion air to a burner. The combustion fan is controlled so as to drive at target rotation speed according to the target combustion quantity of the burner, and supplies combustion air quantity according to the target combustion quantity of the burner to a combustion chamber so as to attain an optimum air fuel ratio. Consequently, the combustion state in the combustion chamber becomes excellent.

The density of air taken in the air supply passage from outdoors is different depending on the altitude of the installation location of the warm air heater. Therefore, even when the combustion fan drives at the same rotation speed, the quantity of combustion air supplied to the combustion chamber through the air supply passage changes. Accordingly, a measure to supply the optimum quantity of combustion air to the combustion chamber regardless of the altitude of the installation location, or the like is taken.

For example, Japanese Patent Laid-Open No. 4-227409 discloses an oil fan heater in which an air pressure sensing circuit which senses air pressure of combustion air is provided, and the number of rotations of a burner motor is adjusted according to the air pressure sensed by the air pressure sensing circuit.

Additionally, Japanese Patent Laid-Open No. 2004-163045 discloses that an air damper is selectively installed in an air supply passage according to the altitude of the installation location of a warm air heater, or the air supply passage, when the warm air heater is installed. The air damper is formed with a hole through which combustion air passes, and a plurality of air dampers whose hole areas are different stepwise are prepared.

Furthermore, Japanese Patent Laid-Open No. 2002-317929 discloses a combustion apparatus which comprises a switch which is manually selected according to the entire length of an exhaust pipe, and a switch which is manually selected according to the altitude of an installation location, in which the driving of a blower or combustion gas supply quantity is corrected according to the setting states of these switches.

However, the oil fan heater disclosed in the above Japanese Patent Laid-Open No. 4-227409 needs to be provided with the air pressure sensing circuit which senses the air pressure of combustion air.

In the warm air heater and the combustion apparatus disclosed in the above Japanese Patent Laid-Open No. 2004-163045 and Japanese Patent Laid-Open No. 2002-317929 respectively, an installation worker or the like needs to select and install a proper air damper, or to properly set the switches, according to the altitude of the installation location or the air supply passage.

The present invention has been made in view of the above background, and an object of the present invention is to provide a warm air heater capable of optimizing a combustion state in a combustion chamber, with no additional device provided therein, without setting work or the like by an installation worker or the like, even when the altitude of an installation location is changed.

SUMMARY OF THE INVENTION

The present invention has been made in order to attain the above object, and a warm air heater of the present invention comprises a burner which is disposed in a combustion chamber, a fuel supply unit which supplies fuel gas to the burner, an air supply passage which communicates the combustion chamber with outdoors, a combustion fan which is disposed in the air supply passage, and supplies air in the outdoors to the combustion chamber through the air supply passage, an orifice which is provided in the air supply passage, a differential pressure detection unit which detects differential pressure between front and rear of the orifice in the air supply passage, a combustion control unit which rotates the combustion fan based on target combustion quantity of the burner, and causes the fuel supply unit to supply the fuel gas to allow the burner to burn, and a correction unit which corrects rotation speed of the combustion fan based on the differential pressure detected by the differential pressure detection unit.

According to the present invention, the differential pressure detection unit detects differential pressure between the front and the rear of the orifice provided in the air supply passage. As described in DETAILED DESCRIPTION OF THE PREFERRED EMBODIMENT, an air density ratio which is a ratio of reference air density of the inside of the air supply passage in a reference state (e.g., the altitude of the installation location is 0 m above sea level), to air density of the inside of the air supply passage in the current state of this warm air heater can be obtained on the basis of this differential pressure.

The correction unit corrects the rotation speed of the combustion fan on the basis of this air density ratio, and then, the combustion control unit operates the combustion fan to supply the fuel gas, so that the combustion state in the combustion chamber can be made optimum regardless of the altitude of the installation location of the warm air heater. As disclosed in the above Japanese Patent Laid-Open No. 2004-163045 or Japanese Patent Laid-Open No. 2002-317929, an installation worker or the like does not need to perform work according to the altitude of the installation location at the time of installation.

In the present invention, the correction unit preferably corrects supply quantity of the fuel gas supplied by the fuel supply unit, on the basis of the differential pressure detected by the differential pressure detection unit.

In this case, similarly to the air density ratio, the correction unit corrects the supply quantity of the fuel gas supplied by the fuel supply unit on the basis of the combustion gas density ratio which changes according to the altitude, and therefore while the target combustion quantity of the burner is secured, the combustion state in the combustion chamber can be made optimum regardless of the altitude of the installation location of the warm air heater.

A correction value when the correction unit corrects the rotation speed of the combustion fan, and a correction value when the correction unit corrects supply quantity of the fuel gas may be different.

Generally, in the warm air heater, when an abnormality such as the blocking of the air supply passage and the exhaust passage, or the presence of a hole in the air supply passage occurs, the abnormality of the air supply passage or the like is detected on the basis of the differential pressure detected by the differential pressure detection unit, in order to stop combustion. Therefore, a general warm air heater originally comprises a unit which is equivalent to the differential pressure detection unit of the present invention. Accordingly, the combustion state in the combustion chamber can be made optimum without providing any additional device, like the above Japanese Patent Laid-Open No. 4-227409.

In the present invention, the warm air heater preferably comprises an abnormality detection unit which detects presence and absence of an abnormality of the air supply passage based on the differential pressure detected by the differential pressure detection unit.

DETAILED DESCRIPTION OF THE PREFERRED EMBODIMENT

A warm air heater 100 according to an embodiment of the present invention will be described. The warm air heater 100 is a forced supply and exhaust (FF) type gas warm air heater.

Figure 1:
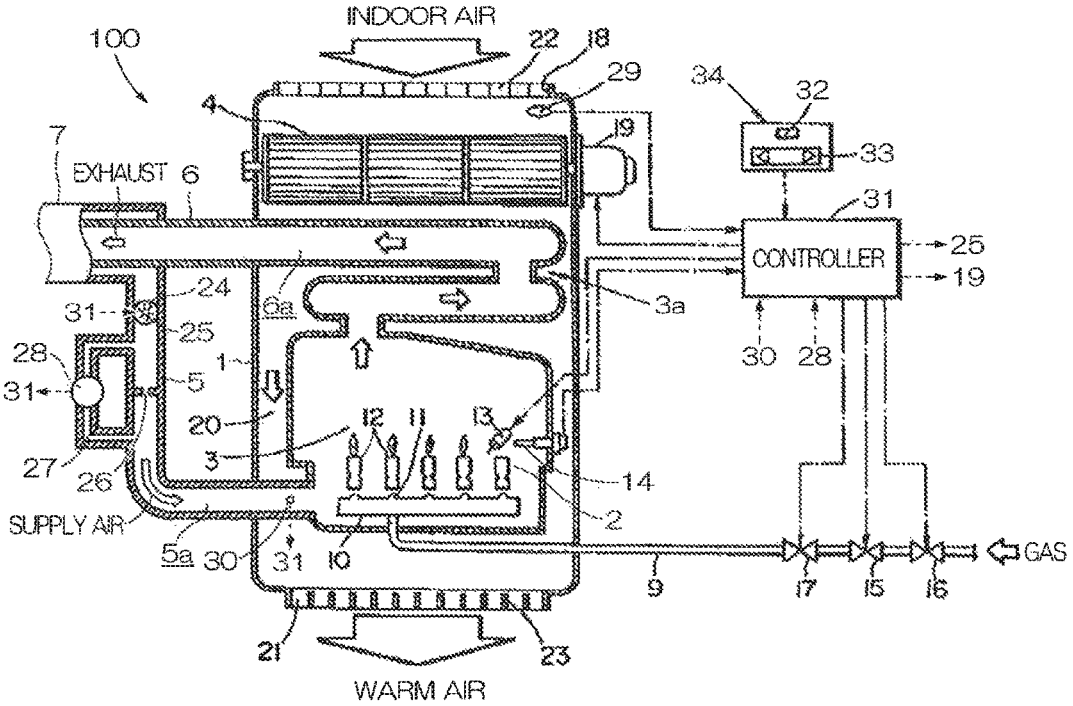
FIG. 1 is a configuration diagram of a warm air heater according to an embodiment of the present invention.

With reference to FIG. 1, the warm air heater 100 comprises a combustion chamber 3 which houses a burner 2 serving as a heat source part, a heat exchange part 3*a* which is continued to the combustion chamber 3, and a convection fan 4 which convects indoor air through the heat exchange part 3*a*, in a body case 1 disposed indoors.

In order to cover and illustrate major components equipped in the warm air heater 100, FIG. 1 shows the warm air heater in plan view, by slightly changing the arrangement of the components from actual arrangement such that components disposed at a low position in actual space arrangement of the warm air heater 100 is not concealed under components disposed at a high position.

An air supply cylinder 5 which extends to the outside of the body case 1 is connected to the combustion chamber 3. Similarly, an exhaust cylinder 6 which extends to the outside of the body case 1 is connected to the combustion chamber 3 through the heat exchange part 3*a*. The air supply cylinder 5 and the exhaust cylinder 6 become a collecting pipe 7 at a distal end which is an end far from the body case 1, and the collecting pipe 7 has a coaxial arrangement structure in which the outside is the air supply cylinder 5 and the inside is the exhaust cylinder 6. The collecting pipe 7 passes through a wall of a building to reach outdoors at the distal end.

The air supply cylinder 5 and the exhaust cylinder 6 form an air supply passage 5*a* and an exhaust passage 6*a* which communicate from the air supply side and the exhaust side to the combustion chamber 3 respectively, on the inner peripheral sides. The air supply passage 5*a* and the exhaust passage 6*a* open outdoors at the distal end of the collecting pipe 7.

A nozzle distributing pipe 10 is disposed in the lower part of the combustion chamber 3, and equipped with a plurality of nozzles 11. A gas supply pipe 9 is introduced from the outside to the inside of the body case 1, and communicated with the nozzle distributing pipe 10. The burner 2 in the combustion chamber 3 is configured by a plurality of mixing parts 12, each of which is arranged to face a corresponding one of the plurality of the nozzles 11. Each mixing part 12 sucks and mixes fuel gas jetted from each nozzle 11 and combustion air introduced from the air supply cylinder 5 into the combustion chamber 3, jets the mixed gas from the distal end, and burns the mixed gas.

In the combustion chamber 3, an ignition electrode 13 which performs the ignition of the burner 2, and a flame rod 14 for detecting the presence or absence of misfire or accidental fire of the burner 2 are provided so as to face the distal ends of the mixing parts 12.

Two opening/closing solenoid valves 15 and 16, and a gas proportional valve 17 are provided in the gas supply pipe 9. The opening/closing solenoid valves 15 and 16 open/close the gas supply pipe 9 to permit or block the flow of combustion gas in the gas supply pipe 9. The gas proportional valve 17 controls the flow rate of the combustion gas in the gas supply pipe 9 according to an opening. The gas supply pipe 9 and the gas proportional valve 17 correspond to a fuel supply unit in the present invention.

The convection fan 4 is provided in the body case 1 so as to face a suction port 18 formed in the back surface part of the body case 1, and is connected to a convection fan motor 19 for rotationally driving the convection fan 4. The convection fan 4 sucks indoor air through the suction port 18 by the rotation, and the sucked air is sent to an air blowing passage 20 in the body case 1 formed with the heat exchange part 3*a*.

Furthermore, the convection fan 4 sends air heated by combustion heat of the burner 2 in the heat exchange part 3*a* of the air blowing passage 20, from an outlet 21 formed in the front surface part of the body case 1 into the room, thereby convecting indoor air. The suction port 18 is equipped with a filter 22, and the outlet 21 is assembled with a louver 23 for adjusting the blowing direction of warm air.

A combustion fan 24 is disposed in the air supply passage 5*a*, and is connected to a combustion fan motor 25 for rotationally driving the combustion fan 24. An orifice 26 is formed on a downstream side of the combustion fan 24 in the air supply passage 5*a*. A passage 27 which is communicated with the air supply passage 5*a* at the front and the rear of the orifice 26 is provided in parallel to the air supply passage 5*a*, and a differential pressure sensor 28 is disposed in the passage 27. The differential pressure sensor 28 detects differential pressure between the front and the rear of the orifice 26 in the air supply passage 5*a*. The differential pressure sensor 28 corresponds to a differential pressure detection unit of the present invention.

A room temperature sensor 29 is provided so as to face the suction port 18 disposed in the back part of the inside of the body case 1, and detects the temperature (room temperature) of indoor air sucked by the convection fan 4. A supply air temperature sensor 30 is disposed in the air supply passage 5*a*, and detects the temperature (supply air temperature) of combustion air introduced in the combustion chamber 3 through the air supply passage 5*a*.

The warm air heater 100 further comprises a controller 31 for controlling heating operation, an operation device 34 which comprises an operation switch 32 for allowing a user to instruct the start and the stop of the heating operation, a room temperature setting switch 33, and the like. The controller 31 corresponds to a combustion control unit, a correction unit, and an abnormality detection unit of the present invention.

The controller 31 is given a signal indicating the presence and absence of accidental fire of the burner 2 or the like, a signal indicating differential pressure Δp, a signal indicating a detected room temperature, a signal indicating the stop and instruction of the heating operation by the user, a signal indicating a target room temperature, and the like, from the flame rod 14, the differential pressure sensor 28, the room temperature sensor 29, the supply air temperature sensor 30, and the operation switch 32 and the room temperature setting switch 33 of the operation device 34. The controller 31 drives the ignition electrode 13, the opening/closing solenoid valves 15 and 16, the gas proportional valve 17, the convection fan motor 19, and the combustion fan motor 25, on the basis of these signals.

Data of an initial opening, initial rotation speed, and the like related to initial operation (FIG. 2) is stored in a ROM of the controller 31. In the ROM, data of standard differential pressure Δpf, a standard opening, and the like in a reference state related to each speed of the standard operation (FIG. 2) is stored. Additionally, in the ROM, data indicating reference values of density $\rho_0$, differential pressure $\Delta p_0$, and the like of combustion air in the reference state, and various threshold values are stored.

When the rotation speed of the combustion fan motor 25 is kept constant, and the combustion fan 24 is rotationally driven, the volume per unit time of combustion air which passes through the air supply passage 5*a* becomes constant. However, when the altitude of the installation location of the warm air heater 100 is different, the density ρ of air taken in the air supply passage 5*a* from the outdoors is different.

Therefore, even when the number of driving rotations of the combustion fan 24 is the same, the mass flow rate $Q_M$ per unit time of combustion air supplied from the air supply passage 5*a* to the combustion chamber 3 is often different. Accordingly, it is necessary to adjust the number of driving rotations of the combustion fan 24 in order to supply the mass flow rate $Q_M$ of combustion air, the mass flow rate $Q_M$ being associated with the target combustion quantity.

The orifice 26 is provided in the air supply passage 5*a*, and therefore differential pressure Δp is generated between combustion air which passes through the air supply passage 5*a* at the front of the orifice 26 and combustion air which passes through the air supply passage 5*a* at the rear of the orifice 26. It is assumed that the pressure and the speed of combustion air in the air supply passage 5*a* on the upstream side of the orifice 26 are denoted by $p_1$ and $v_1$ respectively, the pressure and the speed of combustion air in the air supply passage 5*a* on the downstream side of the orifice 26 are denoted by $p_2$ and $v_2$ respectively, and the density of combustion air is denoted by ρ. When the combustion air in the air supply passage 5*a* approximates steady flow, Expression (1) is established from Bernoulli's theorem.

$$p_1 + \frac{1}{2}\rho v_1^2 = p_2 + \frac{1}{2}\rho v_2^2 \tag{1}$$

Assuming that $S_1$ denotes the cross-sectional area of the air supply passage 5*a* on the upstream side of the orifice 26, and $S_2$ denotes the cross-sectional area of the air supply passage 5*a* on the downstream side of the orifice 26, the volume flow rate $Q_V$ of combustion air is expressed by Expression (2) from a continuous expression.

$$Q_v = S_1 v_1 = S_2 v_2 \tag{2}$$

The volume flow rate $Q_V$ of combustion air is expressed by Expression (3) from Expressions (1) and (2), and it is found that the volume flow rate $Q_V$ depends on the differential pressure Δp ($=p_1-p_2$).

$$Q_v = \frac{2S_2}{\sqrt{1-(S_2/S_1)^2}}\sqrt{(P_1-P_2)/\rho} = k\cdot\sqrt{\Delta P/\rho} \tag{3}$$

where $$k = \frac{2S_2}{\sqrt{1-(S_2/S_1)^2}}$$

The mass flow rate $Q_M$ of combustion air is expressed by Expression (4) from Expression (3).

$$Q_M = \rho\cdot Q_v = k\sqrt{\rho\cdot\Delta P} \tag{4}$$

Herein, a reference state (e.g., a state where the warm air heater 100 is installed at an altitude of 0 m above sea level) is compared with an actual state where the warm air heater 100 is actually installed. It is assumed that the density and the differential pressure of combustion air in the air supply passage 5*a* in the reference state are denoted by $\rho_0$ and $\Delta p_0$ respectively, and the density and the differential pressure of combustion air in the air supply passage 5*a* in the actual state are denoted by $\rho_a$ and $\Delta p_a$ respectively.

In a case where the rotation speed of the combustion fan 24 is kept constant, the volume flow rates $Q_V$ per unit time of the combustion air supplied from the air supply passage 5*a* to the combustion chamber 3 in the above both states are the same. Accordingly, Expression (5) is derived from Expression (3).

$$\Delta p_a = t\cdot\Delta p_0 \text{ where } t = \rho_a/\rho_0 \tag{5}$$

In the case where the rotation speed of the combustion fan 24 is kept constant, the mass flow rate $Q_{M0}$ per unit time of the combustion air in the reference state and the mass flow rate $Q_{ma}$ per unit time of the combustion air in the actual state satisfy the relation of Expression (6) which is derived from the Expressions (4) and (5). It is understood from Expression (6) that the mass flow rate $Q_{Ma}$ per unit time of the combustion air in the actual state is obtained by multiplying the mass flow rate $Q_{M0}$ per unit time of the combustion air in the reference state by an air density ratio t.

$$Q_{Ma} = t\cdot Q_{Mo} \tag{6}$$

On the other hand, control pressure for adjusting the opening of the gas proportional valve 17 is kept constant regardless of the altitude. It is assumed that the density and the mass flow rate per unit time of combustion gas supplied from the gas supply pipe in the reference state are denoted by $\rho_{g0}$, and $Qg_{M0}$ respectively, and the density and the mass flow rate per unit time of combustion gas supplied from the gas supply pipe in the actual state are denoted by $\rho_{ga}$ and $Qg_{gMa}$ respectively. In this case, the relation of Expression (7) exists. It is understood from Expression (7) that the mass flow rate $Q_{gMa}$ per unit time of the combustion gas in the actual state is obtained by multiplying the mass flow rate $Q_{gM0}$ per unit time of combustion gas in the reference state by air density ratio $t^{1/2}$.

$$Qg_{Ma} = \sqrt{\rho_{ga}/\rho_{g0}}\cdot Qg_{M0} = \sqrt{t}\cdot Qg_{M0} \tag{7}$$

Figure 2:
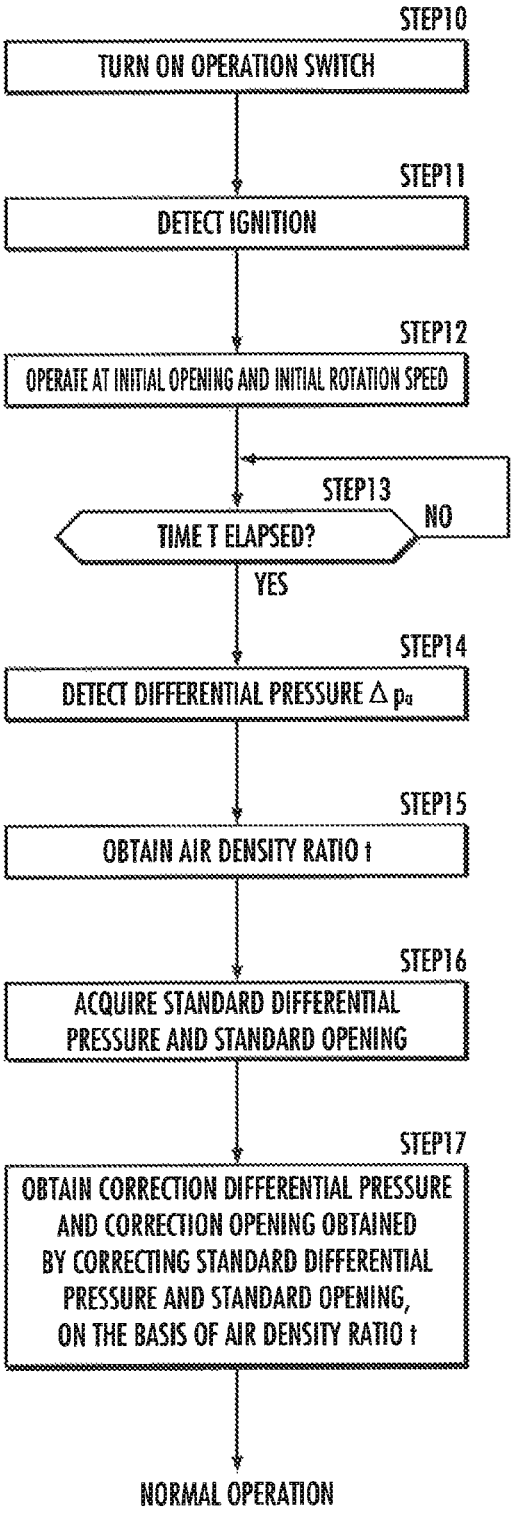
FIG. 2 is a flowchart of an initial operation part.

Hereinafter, with reference to FIG. 2, control during initial operation will be described. This control is started by first turning on the operation switch 32 in STEP 10 when the warm air heater 100 is installed.

When the operation switch 32 is turned on in STEP 10, and the ignition electrode 13 performs the ignition of the burner 2, and the flame rod 14 detects the ignition in STEP 11.

In STEP 12, the gas proportional valve 17 is adjusted to an initial opening corresponding to initial combustion quantity, and the power supply voltage of the combustion fan motor 25 is controlled such that the combustion fan 24 rotates at initial rotation speed. In the warm air heater 100, the rotation speed control of the combustion fan 24, and the opening control of the gas proportional valve 17 are a feedforward system. However, a feedback system can be also employed.

In STEP 13, it is determined whether or not predetermined time T is elapsed from the setting of the initial rotation speed in STEP 12. When the predetermined time T is elapsed, the process advances to STEP 14.

In STEP 14, the differential pressure sensor 28 detects differential pressure $\Delta p_a$.

In STEP 15, an air density ratio t of the air density $\rho_a$ of the combustion air supplied from the air supply passage 5*a* to the combustion chamber 3, to the air density $\rho_0$ of the combustion air in the reference state is obtained from the above Expression (5) in reference to reference differential pressure $\Delta p_0$ in the reference state already stored in the ROM. Then, the obtained air density ratio t is stored in a flash memory.

In STEP 16, data of standard differential pressure and a standard opening in the reference state related to each speed is acquired in reference to the ROM.

In STEP 17, correction differential pressure, and a correction opening obtained by correcting the data of the standard differential pressure, and the standard opening related to each speed are obtained on the basis of the air density ratio t. Specifically, standard differential pressure $\Delta p_{f0}$ related to each speed is corrected to $t \cdot \Delta p_{fa}$, in reference to Expression (5). Then, the standard opening related to each speed is corrected such that the combustion gas supply quantity becomes $t^{1/2}$ times, with respect to a case where the opening of the gas proportional valve 17 is the standard opening, in reference to Expression (7). This correction is performed in reference to, for example, a map stored in the ROM. Thus, a correction value when correcting the rotation speed of the combustion fan 24 is t, a correction value when correcting fuel gas supply quantity is $t^{1/2}$, and these correction values are different from each other.

These corrected correction differential pressure and correction opening related to each speed are stored in the flash memory. Thereafter, the process transfers to control during normal operation shown in FIG. 3.

Figure 3:
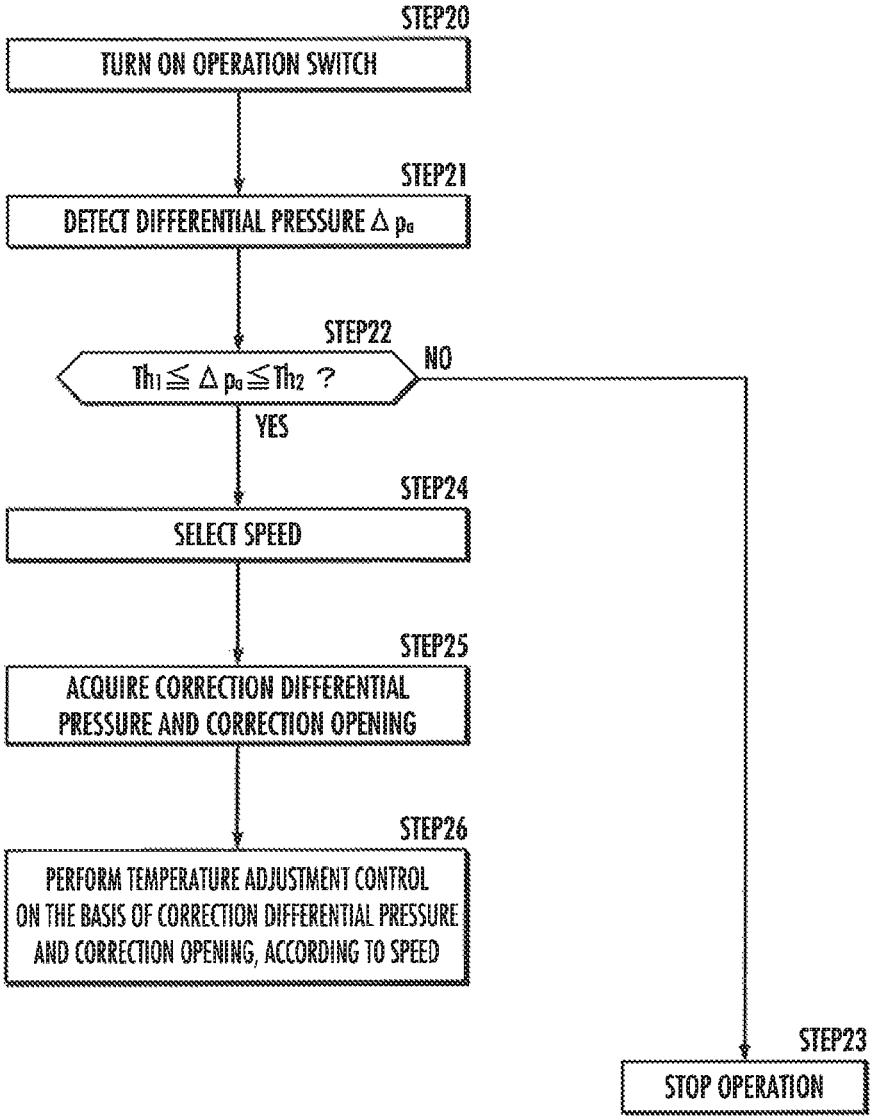
FIG. 3 is a flowchart of a normal operation part.

Hereinafter, with reference to FIG. 3, control during normal operation will be described. This control is started by turning on the operation switch 32 in STEP 20.

First, the differential pressure sensor 28 detects differential pressure $\Delta p_a$ in STEP 21.

In STEP 22, it is determined whether or not the detected differential pressure $\Delta p_a$ is in a range between a threshold value $Th_1$ and a threshold value $Th_2$ stored in the ROM.

In a case where the determination in STEP 22 is negative, operation is stopped in STEP 23. This is because the air supply passage 5*a* or the exhaust passage 6*a* may be blocked in a case where the differential pressure $\Delta p_a$ is less than the threshold value $Th_1$, and a hole may be present in the air supply passage 5*a* in a case where the differential pressure $\Delta p_a$ exceeds the threshold value $Th_2$. The controller 31 which performs operation in STEPS 22 and 23 corresponds to an abnormality detection unit of the present invention.

In a case where the determination in STEP 22 is positive, the process advances to temperature adjustment control of STEP 24 and the subsequent steps.

In STEP 24, at each time point during the operation of the warm air heater 100, speed is selected on the basis of a difference between a target room temperature set by operation with the room temperature setting switch 33 by the user, and a temperature detected as a current room temperature by the room temperature sensor 29.

In STEP 25, data of correction differential pressure and a correction opening related to each speed is acquired in reference to the flash memory.

In STEP 26, the temperature adjustment control of the warm air heater 100 is performed on the basis of the data of the correction differential pressure and the correction opening acquired in STEP 25, according to the speed selected in STEP 24. In the temperature adjustment control of STEP 26, the number of rotations of the combustion fan motor 25 which rotationally drives the combustion fan 24 is adjusted such that the differential pressure $\Delta p_a$ detected by the differential pressure sensor 28 becomes the correction differential pressure $t \cdot \Delta p_0$.

As described above, according to this embodiment, the ratio (air density ratio) t of the reference air density $\rho_0$ of the inside of the air supply passage 5*a* in the reference state, to the air density $\rho_a$ of the inside of the air supply passage 5*a* in the current state of the warm air heater 100 is obtained in reference to Expression (5) on the basis of the differential pressure $\Delta p_a$ detected by the differential pressure sensor 28, at the time of the initial operation in which the warm air heater 100 is installed. Then, data of the standard differential pressure and the standard opening related to each speed is corrected on the basis of the obtained air density ratio t, to obtain the correction differential pressure, and the correction opening.

Accordingly, the combustion state in the combustion chamber 3 can be made optimum regardless of the altitude of the installation location of the warm air heater 100. As disclosed in the above Japanese Patent Laid-Open No. 2004-163045 or Japanese Patent Laid-Open No. 2002-317929, an installation worker or the like does not need to perform work according to the altitude of the installation location at the time of installation.

Then, an abnormality such as the blocking of the air supply passage 5*a* or the exhaust passage 6*a*, and the presence of a hole in the air supply passage 5*a* is detected on the basis of the differential pressure $\Delta p_a$ detected by the differential pressure sensor 28. Thus, a general warm air heater comprises the differential pressure sensor 28 in order to detect the abnormality of the air supply passage 5*a* or the like. Accordingly, the combustion state in the combustion chamber 3 can be made optimum regardless of the altitude of the installation location of the warm air heater 100, without providing any additional device, like the above Japanese Patent Laid-Open No. 4-227409.

Thus, the embodiment of the present invention is described with reference to the drawings, but the present invention is not limited to this. For example, the orifice 26 is installed on the downstream side of the combustion fan 24 in the air supply passage 5*a* in the above embodiment, but may be installed on the upstream side of the combustion fan 24 in the air supply passage 5*a*.

Additionally, in the above description, in STEP 16, the standard differential pressure $\Delta p_{f0}$ related to each speed is corrected to the correction differential pressure $t \cdot \Delta p_{fa}$, and the standard opening is corrected to the correction opening in which combustion gas supply quantity is $t^{1/2}$ times, on the basis of the air density ratio t obtained in STEP 15, and the number of rotations of the combustion fan motor 25 which rotationally drives the combustion fan 24 is adjusted such that the differential pressure $\Delta p_a$ detected by the differential pressure sensor 28 becomes the correction differential pressure $t \cdot \Delta p_0$, and the opening of the gas proportional valve 17 is made to be the correction opening. However, the present invention is not limited to this.

For example, the number of rotations of the combustion fan motor 25 which rotationally drives the combustion fan 24 may be adjusted such that the differential pressure $\Delta p_a$ detected by the differential pressure sensor 28 becomes the standard differential pressure $\Delta p_{f0}$, and the opening of the gas proportional valve 17 may be made to be the standard opening. Consequently, although target combustion quantity is not obtained, the combustion state in the combustion chamber 3 can be made optimum. In this case, it is not necessary to obtain the air density ratio t, and control is facilitated.

In STEP 16, the standard number of rotations of the combustion fan motor 25 related to each speed may be corrected on the basis of the map or the like stored in the ROM, in place of the correction of the standard differential pressure $\Delta p_{f0}$ related to each speed on the basis of the air density ratio t obtained in STEP 15, and the corrected number of rotations may be obtained, and the combustion fan motor 25 may be controlled so as to rotate at the corrected number of rotations.

In the above description, the data of the initial opening and the initial rotation speed related to the initial operation is stored in the ROM. However, data of an initial opening, initial rotation speed, and the like in a reference state related to specific speed of standard operation may be used as the data of the initial opening, the initial rotation speed, and the like. Furthermore, a plurality of groups of the data of the initial opening, and the initial rotation speed related to the initial operation may be used, and the air density ratio t may be obtained by obtaining an average value or the like, on the basis of the initial operation of each group.

Furthermore, even when the length or the bending of the air supply passage 5*a*, or the like is different, the mass flow rate $Q_M$ of the combustion air supplied from the air supply passage 5*a* to the combustion chamber 3 is different. In the present invention, the combustion state in the combustion chamber 3 can be made optimum regardless of difference in the mass flow rate $Q_M$ of the combustion air due to a factor other than the difference in the altitude of the installation location of the warm air heater 100.

What is claimed is:

1. A warm air heater comprising:

a burner which is disposed in a combustion chamber;

a fuel supply unit which supplies fuel gas to the burner;

an air supply passage which communicates the combustion chamber with outdoors;

a combustion fan which is disposed in the air supply passage, and supplies air in the outdoors to the combustion chamber through the air supply passage as combustion air;

an orifice which is provided in the air supply passage;

a differential pressure detection unit which detects differential pressure between front and rear of the orifice in the air supply passage;

a combustion control unit which rotates the combustion fan based on target combustion quantity of the burner, and causes the fuel supply unit to supply the fuel gas to allow the burner to burn;

an abnormality detection unit which detects presence and absence of an abnormality of the air supply passage based on the differential pressure detected by the differential pressure detection unit; and a correction unit which, based on the differential pressure detected by the differential pressure detection unit, obtains an air density ratio which is a ratio of a mass flow rate of the combustion air with respect to a reference mass flow rate of combustion air in a reference state, and based on the air density ratio, obtains a first correction value for correcting a rotation speed of the combustion fan from a reference rotation speed of the reference state such that the rotation speed of the combustion fan increases as the ratio decreases; and wherein the correction unit, based on the air density ratio, obtains a second correction value for correcting a supply quantity of the fuel gas supplied by the fuel supply unit from a reference supply quantity of the reference state, such that the supply quantity of the fuel gas increases as the air density ratio decreases.

2. The warm air heater according to claim 1, wherein the first correction value is different from the second correction value.

* * * * *